United States Patent [19]

Sasaki

[11] 4,325,164

[45] Apr. 20, 1982

[54] OFFSET PIVOT HINGES WITH DOOR CLOSING DEVICES

[75] Inventor: Kyoichi Sasaki, Tokyo, Japan

[73] Assignee: Nippon Electric Industry Co., Ltd., Tokyo, Japan

[21] Appl. No.: 66,658

[22] Filed: Aug. 15, 1979

[30] Foreign Application Priority Data

| | | | |
|---|---|---|---|
| Aug. 19, 1978 | [JP] | Japan | 53-112962[U] |
| Feb. 14, 1979 | [JP] | Japan | 54-16604 |
| Feb. 14, 1979 | [JP] | Japan | 54-16605 |
| Feb. 14, 1979 | [JP] | Japan | 54-16606 |
| Feb. 14, 1979 | [JP] | Japan | 54-166071 |
| Jun. 27, 1979 | [JP] | Japan | 54-80078 |

[51] Int. Cl.[3] ..... E05F 3/20; E05F 3/22

[52] U.S. Cl. ..... 16/55; 16/52; 16/76; 16/68

[58] Field of Search ..... 16/55, 56, 57, 58, 52, 16/71, 75, 76, 84, 66

[56] References Cited

U.S. PATENT DOCUMENTS

| | | | |
|---|---|---|---|
| 1,836,383 | 12/1931 | Mitchell | 16/58 |
| 2,688,150 | 9/1954 | Roussel | 16/57 X |
| 3,354,497 | 11/1967 | Armento | 16/55 |
| 3,449,789 | 6/1969 | Russell et al. | 16/55 |
| 4,068,344 | 1/1978 | Okabe | 16/56 X |

FOREIGN PATENT DOCUMENTS

| | | | |
|---|---|---|---|
| 2528993 | 1/1976 | Fed. Rep. of Germany | 16/52 |
| 2541790 | 3/1977 | Fed. Rep. of Germany | 16/52 |
| 1348887 | 3/1974 | United Kingdom | 16/52 |

*Primary Examiner*—Wayne L. Shedd

*Attorney, Agent, or Firm*—Carothers and Carothers

[57] ABSTRACT

A door closing device which is easily mounted on, and easily removed from, an offset pivot hinge. The door closing device has an outer sleeve, an inner member rotatably mounted in the outer sleeve and a coil spring having opposite ends thereof connected to the outer sleeve and the inner member, respectively. The door closing device is mounted on, and operatively connected to, the pivot hinge by non-rotatably fitting the inner member and the outer sleeve with a pivot pin of the pivot hinge and a hinge plate pivoted on the pivot pin, respectively .

The door closing device is provided with a door closing speed damping mechanism, a door stopper mechanism, and/or a preset mechanism for the door closing torque, which are assembled within the outer sleeve.

13 Claims, 14 Drawing Figures

OFFSET PIVOT HINGES WITH DOOR CLOSING DEVICES

BACKGROUND OF THE INVENTION

This invention relates to automatic door closing devices, and, in particular, to offset pivot hinges with automatic door closing mechanism.

A well known pivot door hinge comprises a plate having a pivot pin secured thereon and another plate pivotally mounted on the pivot pin. One of these plates is mounted on the floor or the door frame. Thus, the door is rotatable around the vertical pivot axis for opening and closing.

One type of such a pivot hinge is known as an offset pivot hinge wherein the pivot pin axis is offset from the vertical door edge.

It has also been desired to have an automatic door closing mechanism for such door hinges. In the existing pivot hinges having door closing mechanism, the mechanism is assembled onto one of the hinge mounting plates or within a housing secured onto the plate.

When installing a door using hinges having a door closing mechanism, the installation operation is difficult because of the existence of door closing torque in the mechanism. The large volume of the hinge also makes the installation operation difficult.

When an automatic door closing function is required for doors using conventional pivot hinges, exchange of the used hinge for a hinge having the door closing mechanism must be easily accomplished.

SUMMARY OF THE INVENTION

An object of this invention is to provide an offset pivot hinge with a door closing device easily and removably assembled thereto.

Another object of this invention is to provide an offset pivot hinge with a door closing device easily and removably assembled thereto, wherein the door closing device has a mechanism for damping door closing speed.

Still another object of this invention is to provide an offset pivot hinge with a door closing device which is easily and removably assembled thereto, wherein the door closing speed is readily adjustable.

Yet another object of this invention is to provide an offset pivot hinge with a door closing device easily and removably assembled thereto, wherein the door closing device has a mechanism for keeping the door open at a predetermined door opening angular position.

A further object of this invention is to provide an offset pivot hinge with a door closing device easily and removably assembled thereto, wherein the door closing device has a mechanism for presetting the door closing torque which is sufficient to completely close the door after installing the door using the hinge.

Another further object of this invention is to realize the above objects packaged in a simple and compact structure at a low cost.

According to this invention, an offset pivot hinge with a door closing device easily and removably assembled thereto is obtained. The offset pivot hinge comprises, a first plate member to be secured to either the door or alternately the floor or a door frame, pivot pin secured onto a surface of one end portion of the first plate member, and a second plate member to be secured to the other of either the door or alternately the floor or the door frame, with the second plate member being pivoted on the pivot pin at one end portion thereof. The closing device comprises an outer sleeve which is a housing of this device, an inner member being rotatably mounted in the outer sleeve, and a coil spring disposed within the outer sleeve. Opposite ends of the coil spring are connected to the outer sleeve and the inner member, respectively, so that the coil spring may be twisted by relative rotation of the outer sleeve and the inner member. The door closing device is easily and removably connected to the pivot hinge at one end thereof by a non-rotatable fitting connection between the one end of the outer sleeve and the one end of the second plate, and by a non-rotatable fitting connection between the one end of the inner member and the extending end of the pivot pin.

An easily loosened set screw is used for securing the outer sleeve to the second plate.

Therefore, when the door closing device is mounted on the pivot hinge, the inner member is connected to the pivot pin, and the outer sleeve is connected to the second plate which is pivoted onto the pivot pin. Accordingly, the relative rotation of the pivot pin and the second plate due to the door opening causes the relative rotation of the inner member and the outer sleeve to twist the coil spring. The restoring force of the coil spring provides the door closing torque.

Since the connection of the door closing device and the pivot hinge is made by the connection between the outer sleeve and the second plate and between the inner member and the pivot pin and by use of a set screw, the mounting operation of the door closing device onto the pivot hinge and the removing operation of the door closing device from the pivot hinge are readily carried out.

The closing device may advantageously have a mechanism for damping the door closing speed which comprises an oil containing cylinder member and a piston member fitted into the cylinder member. The cylinder member is secured to the inner member and is rotatably supported within, and in relation to, the outer sleeve. The piston member is made reciprocal within the cylinder by the relative rotation of the inner member and the outer sleeve. The piston member is provided with a check valve permitting unidirectional oil flow between both sides of the piston member, and with an oil hole permitting oil flow between both sides of the piston member. The check valve prevents the oil from flowing therethrough at such time when the piston member moves due to door closure. Thus, the door closing speed is damped.

An adjuster rod is disposed through the oil hole of the piston. The adjuster rod is milled to form a tapered surface to define an oil flowing gap along the tapered surface in the oil hole. The adjuster rod is non-rotatably but axially slidably connected to a manually operable rod which is rotatably secured to the outer sleeve, so that the oil flowing gap along the tapered surface in the oil hole may be adjustable by manual operation of the manually operable rod. Thus, the door closing speed is adjustable.

The door closing device may advantageously have a preset mechanism for keeping the coil spring under the twisted condition in order to provide door closing torque sufficient to completely close the door. The preset mechanism comprises a preset screw for securing the outer sleeve and the inner member under the condition that the coil spring is twisted by a predetermined degree. After installing the door using the pivot hinge and assembling the door closing device onto the hinge, the preset door closing torque is obtained by loosening the preset screw.

The door closing device may advantageously have a door stopper mechanism for keeping the door at a predetermined door opening angular position. The door stopper mechanism comprises a ring member being axially slidably connected to the inner member and having at least one axial projection at a predetermined angular position. A spring member is disposed within the outer sleeve to urge the ring member in the direction of the axial projection. At least one pin member is secured to the outer sleeve so that the pin member may go over the axial projection against the urging spring member during the relative rotation of the outer sleeve and the inner member.

According to another aspect of this invention, the door stopper mechanism comprises a first ring member fixedly fitted into the outer sleeve and having at least one depression in the inside surface. A second inner ring is fixedly fitted on the inner member and is disposed inside of the first ring with an annular gap therebetween. The second ring has at least one groove of a depth equal to the depression of the first ring but smaller than the annular gap, and at least one stopper depression of a depth smaller than the groove, in the outer surface thereof. At least one roller member having a diameter equal to the total amount of the depth of the groove and the annular gap is disposed in the groove. A retainer ring having at least one roller pocket is rotatably disposed within the annular gap. One end of the coil spring is directly connected to the retainer ring in place of the inner member. Therefore, the retainer ring is urged to come in contact with the roller. Since the roller is received in the groove of the second inner ring, the coil spring is connected through the retainer ring, the roller and the second inner ring. Accordingly, the coil spring is twisted by the relative rotation of the outer sleeve and the inner member. During the relative rotation, when the depression of the first ring reaches the roller in the groove, the roller goes into the depression and moves together with the first ring. During further rotation, when the roller arrives at the stopper depression of the second inner ring, the roller is partially removed from the depression of the first ring and is also received in the stopper depression. Accordingly, the relative rotation of the first ring and the second inner ring is restricted by the roller so that the door may be kept open.

Further objects, features and aspects of this invention will be easily understood from the following detailed description of preferred embodiments with reference to the annexed drawings.

DETAILED DESCRIPTION OF PREFERRED EMBODIMENTS

Figure 1:
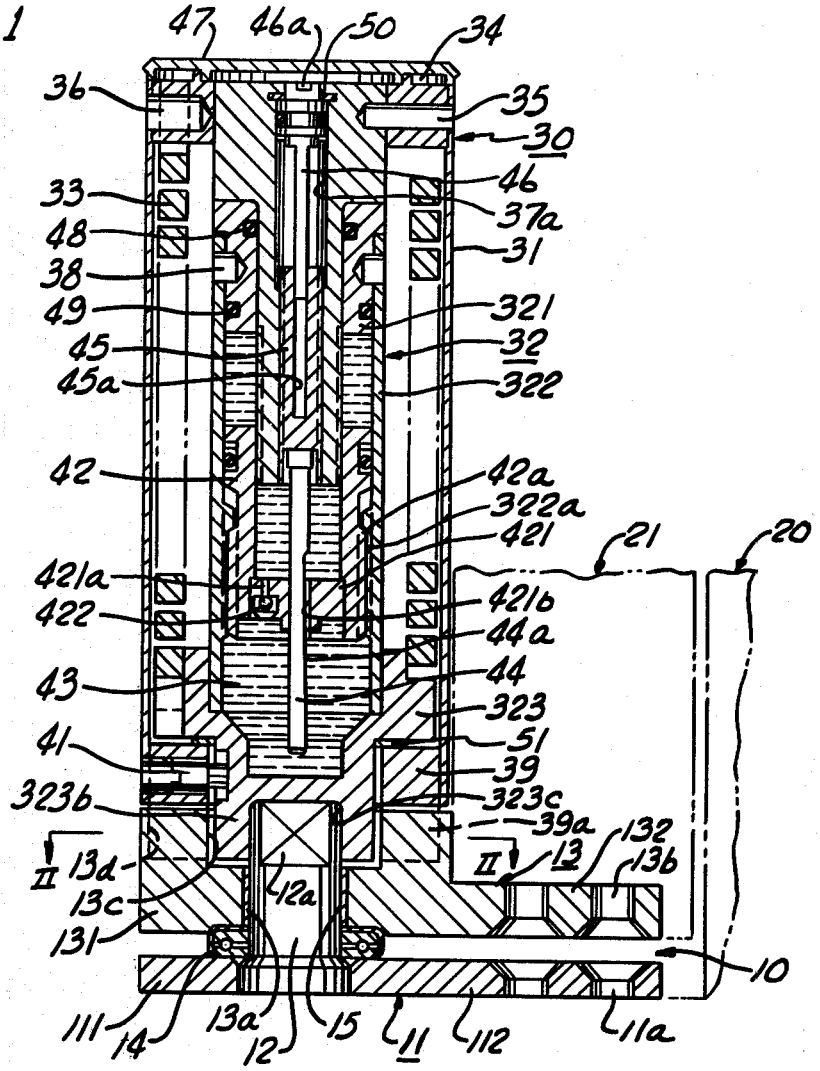
FIG. 1 is a vertical sectional view of an embodiment of this invention.
Figure 2:
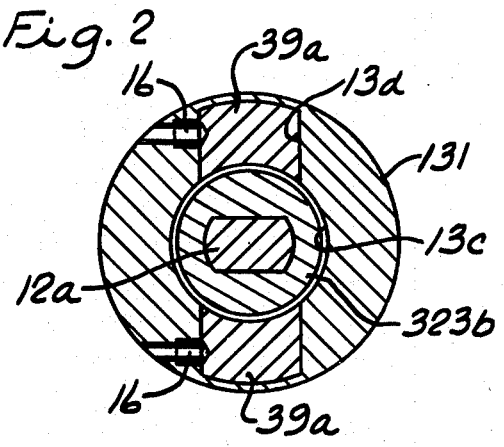
FIG. 2 is a cross-sectional view as seen along the section line II—II in FIG. 1.
Figure 3:
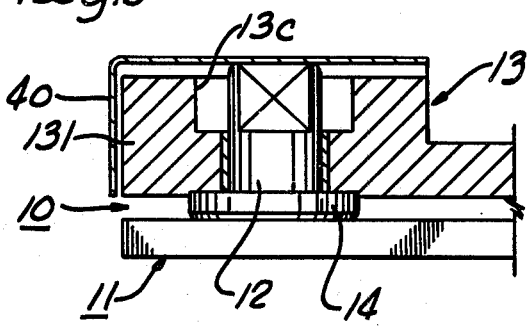
FIG. 3 is a vertical sectional view of the pivot hinge in FIG. 1 with the door closing device removed and a cover plate mounted thereto.
Figure 5:
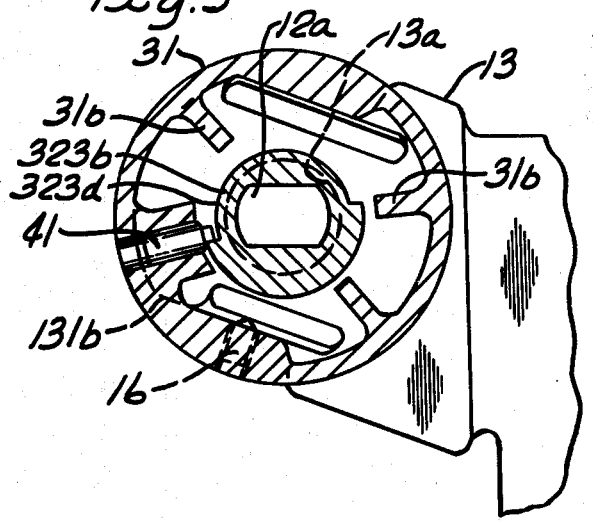
FIG. 5 is a cross-sectional view as seen along the section line V—V in FIG. 4.

Referring to FIGS. 1–3, in which an embodiment of this invention is shown, a pivot hinge 10 comprises a seat plate 11 to be fixed onto a floor under the door, or a door frame 20. The seat plate 11 has a vertical pin 12 defining a pivot axis, on which a door supporting plate 13 is rotatably and pivotally mounted through a thrust ball bearing 14 and a radial bearing 15.

Pivot pin 12 is fixedly secured onto a surface of an end portion 111 of seat plate 11, the other end portion 112 of which is provided with bolt inserting holes **11*a* for receiving bolts to fix the seat plate 11 to the floor. Door supporting plate 13 is provided with a hole 13*a* at an end portion 131 thereof in which the radial bearing 15 is fixedly mounted, and with bolt inserting holes 13*b* at the other end 132 thereof for receiving bolts to fix the supporting plate 13 on the bottom surface of the door 21. Thus, the door 21 is supported on the pivot hinge 10** to pivotally rotate about the pivot axis.

A door closing device 30 is easily and removably attached on the pivot hinge 10.

The door closing device 30 comprises an outer sleeve or housing 31 to be connected with door supporting plate 13, and an inner cylinder member 32 to be connected to the pivot pin 12, which is disposed in, and rotatable in relation to, the outer sleeve 31. A coil spring 33 is disposed around inner cylinder member 32, with an end of the spring being connected to outer sleeve 31 and with the other end being connected to inner cylinder member 32, so that the spring is twisted by opening the door. The restoring force of the twisted spring provides the door closing torque.

In the shown embodiment, a ring member 34 is secured by a pin 35 in an upper end of outer sleeve 31, and the upper end of coil spring 33 is secured by a pin 36 to the ring 34. A hollow damper shaft 37 is fixedly disposed in outer sleeve 31 and is secured by the pin 35 to the upper ring 34 at the upper end thereof.

Inner cylinder member 32 comprises a cylinder head ring 321 which is rotatably mounted on damper shaft 37, a tubular member 322 which is secured by pins 38 to the cylinder head ring 321 at the upper end thereof, and a cup member 323 which is fitted onto, and welded to, the lower end of the tubular member 322. Lower cup member 323 is provided with a groove **323*a* in the upper surface at the peripheral portion, in which the lower end of coil spring 33** is engaged.

Outer sleeve 31 is provided with a lower cap member 39 in a ring form which is formed with projections **39*a*** downwardly extending on the bottom surface thereof. Cup member 323 is also provided with a central projection 323*b* downwardly extending through the central hole of the ring like lower cap member 39. The projection 323*b* is provided with a depression 323*c* in the projecting end for receiving pivot pin 12 when the device 30 is attached to the pivot hinge 10.

Referring to FIG. 2 in addition to FIG. 1, end portion 131 of door supporting plate 13 is provided with a depression 13*c* for receiving projection 323*b* of cup member 323, and recesses 13*d* for receiving projections 39*a* of ring like lower cap member 39, in the upper surface thereof. Pivot pin 12 upwardly extends through a center of, and above, the bottom surface of depression 13*c*, and the extended end portion 12*a* is partially cut away to form a non-annular peripheral surface as shown in FIG. 2. The depression 323*c* of the projection 323*b* is consistent with the non-annular form of the extending end 12*a* of pivot pin 12 so that any relative rotation between pivot pin 12 and lower cup member 323 may be prevented at a time when the extending end 12*a* of pivot pin 12 is received, or fitted, in the depression 323*c* of lower cup member 323. On the other hand, when the projections 39*a* of lower ring like cap member 39 are received in the recesses 13*d* of door supporting member 13, outer sleeve 31 is prevented from rotating in relation to door supporting plate 13.

Accordingly, when the door closing device 30 is attached to the hinge 10 by inserting the projections 39*a* of ring like lower cap member 39 into the recesses 13*d* of door supporting plate 13 and by inserting the pivot pin end 12*a* into the depression 323*c* of cup member 323, coil spring 33 is twisted by door opening, and the restoring force of the coil spring serves to close the door.

In order to prevent the door closing device from automatically removing from the pivot hinge during use, set screws 16 are provided to door supporting plate 13, by which the projections 39*a* of ring like cap member 39 is fixedly secured to door supporting plate 13 in the state that projections 39*a* are received in the recesses 13*d* of door supporting plate 13.

As above described, the door closing device 30 is readily attached to the pivot hinge 10 and is also readily removed from the pivot hinge 10. Therefore, the door installing operation is ready because it is performed using the pivot hinge without the door closing device. The door closing device can be readily attached to the hinge if desired, and it can be readily removed at any time when it is not desired.

In non-use of the door closing device, a cover plate 40 is attached to the end portion 131 of the door supporting plate 13 to cover the upper surface including the depression 13*c* and recesses 13*d*, and the pivot pin 12, as shown in FIG. 3.

In the shown embodiment, a set screw 41 is radially screwed in ring like lower cap member 39 to selectively prevent lower cup member 323, and therefore inner cylinder member 32, from rotating in relation to outer sleeve 31, in order to preset the door closing torque, or the restoring force of the coil spring 33. Thus, the door closing device is presettable to keep the coil spring 33 in twisted condition prior to shipment from the plant, by rotating the lower cup member 323 in relation to the outer sleeve 31 to twist the coil spring 33 and then screwing the screw 41 to prevent rotation of the cup member 323 in relation to the outer sleeve 31. After the door closing device 30 is attached to the pivot hinge 10, the restoring force of the twisted coil spring 33 is transmitted to the door supporting plate 13 by removing the set screw 41.

In order to prevent the door from quickly closing by the restoring force of the coil spring, the shown embodiment is provided with a torque damping mechanism.

Tubular member 322 of cylinder member 32 is provided with a helical groove 322*a* threaded in the inner surface thereof. A piston member 42 screw-threaded in the outer surface thereof as shown by 42*a* is fitted within the tubular member 322, with the outer thread 42*a* mating the helical groove 322*a*. The piston member 42 is a hollow body, in the hollow portion of which the lower end portion of damper shaft 37 extends. The damper shaft 37 slidably but non-rotatably guides the piston member 42 by spline connection therebetween. Thus, piston member 42 is upwardly or downwardly moved along damper shaft 37 by rotation of cylinder member 32 in relation to outer sleeve 31.

The hollow piston member 42 is closed by a valve plate 421 welded thereto at the lower end thereof. The valve plate 421 may be formed as an integral body of the piston member. The valve plate 421 is provided with a small hole 421*a* accompanied by valve ball 422 and another small hole 421*b*. Damper oil 43 is contained in cylinder member 32, to damp the movement of piston member 42, whereby the door closing speed is decreased.

In door opening, piston member 42 moves upwardly in the shown embodiment, and damper oil 43 flows through holes 421*a* and 421*b* downwardly. When the door is closed, piston member 42 moves downwardly. At that time, damper oil flows upwardly through hole 421*b*, but the other hole 421*a* is closed by valve ball 422. Thus, valve ball 422 constitutes a check valve. Accordingly, oil flow is limited by the check valve in door closing operation, whereby moving speed of piston member 42 is limited. Therefore, the door closing speed is damped.

The door closing speed is adjustable by controlling an adjuster rod 44. The adjuster rod is milled to form a tapered surface 44*a*, and extends through the hole 421*b* to establish an oil passing gap along the milled tapered surface 44*a*. The upper end of adjuster rod 44 is secured to a screw 45 which is screwed into a central hole 37*a* of damper shaft 37. The screw 45 is formed with a central square hole 45*a* in which rod 46 is slidably fitted. The square rod 46 extends upwardly through the central hole 37*a* of the damper shaft 37, and is rotatably fixed to damper shaft 37 in the upper end portion thereof. The square rod 46 is formed with a groove 46*a* in the upper end surface for receiving a screw driver bit. Therefore, when square rod 46 is rotated by use of screw driver, screw 45 and adjuster rod 44 are rotated and moved upwardly in dependence on the rotating direction of square rod 46. Accordingly, the oil passing gap along the tapered surface 44*a* of adjuster rod 44 in the hole 421*b* is adjustably changed.

The use of the tapered surface of the adjuster rod has another advantage in that greater damping effect is obtained at the greater door opening angular position.

In FIG. 1, 47 is a top cap, 48, 49, and 50 are O-rings for sealing the inner bore of the cylinder member 32, and 51 is a thrust washer for receiving the cylinder member.

Referring to FIGS. 4–7, another embodiment shown is similar to the above described embodiment, except that a door stopper mechanism is assembled thereto and that a door closing device is removably attached to the pivot hinge by a different arrangement. For purpose of simplification of description, similar parts are shown by the same reference characters as in FIGS. 1–3, and the description of the similar parts will be omitted.

The upper surface of the end portion 131 of door supporting plate 13 is formed flat. Above the flat surface, non-annular extending end 12*a* of pivot pin 12 projects. The peripheral end surface of the end portion 131 is formed non-annular, as shown by 131*a*.

The lower end of outer sleeve 31 partially extends downwardly as shown by 31*a* to have a non-annular inner surface consisting with the non-annular peripheral end surface 131*a* of door supporting plate 13.

Lower cup member 323 of inner cylinder member 32 is supported through a thrust washer 51 on a plurality of fingers 31*b* which project radially inward on the inner surface of outer sleeve 31 near the lower end thereof. Projection 323*b* downwardly projecting from the lower cup member 323 and having non-annular depression 323*c* for receiving pivot pin end 12*a* is formed with such a stepped outer surface 323*d* which comprises two arcuate surfaces of different radii, as clearly shown in FIG. 5. Set screw 41 is screwed in outer sleeve 31 and engages with the step portion of the outer surface 323*d* at the end thereof to prevent the cup member 323 from rotating in relation to the outer sleeve 31. Accordingly, it is able to keep the coil spring 33 in twisted condition.

The door closing device 30 is removably attached to the pivot hinge 10 by inserting the non-annular end 12*a* of pivot pin 12 into the depression 323*c* and by also fitting the extending lower end 31*a* onto the non-annular peripheral end surface 131*a* of door supporting plate 13. Thus, the cylinder member 32 is connected with the pivot pin 12 with no relative rotation. And the outer sleeve 31 is also connected with the door supporting plate 13 with no relative rotation. Accordingly, the restoring force of the twisted coil spring 33 is transmitted to the door 21 as a door closing torque.

It is advantageous that door closing device is provided with a door stopper mechanism to keep the door open at an opening angular position.

In the embodiment shown, a ring 52 is fitted onto tubular member 322 of inner cylinder member 32 and is non-rotatably secured thereto by the pins 38. The ring 52 is provided with axial slots 52*a* for receiving pins 38, and, therefore, is axially slidable but non-rotatable in relation to the inner cylinder member 32. A coil spring 53 is disposed around the tubular member 322. The upper end of the coil spring 53 engages with the lower end of the ring 52, and the lower end is connected to the cylinder member 32, for example, by engaging with the upper end of the cup member 323 as shown. Thus, the ring 52 is urged to the highest position limited by the axial slots 52*a*. The ring 52 is provided with at least one axial projection 52*b* at the upper end thereof. Two projections are shown in the embodiment.

Two pins 54 corresponding to the axial projections 52*b* are fixed on the outer surface of the damper shaft 37 to be in contact with the axial upper end of the ring 52.

Figure 7:
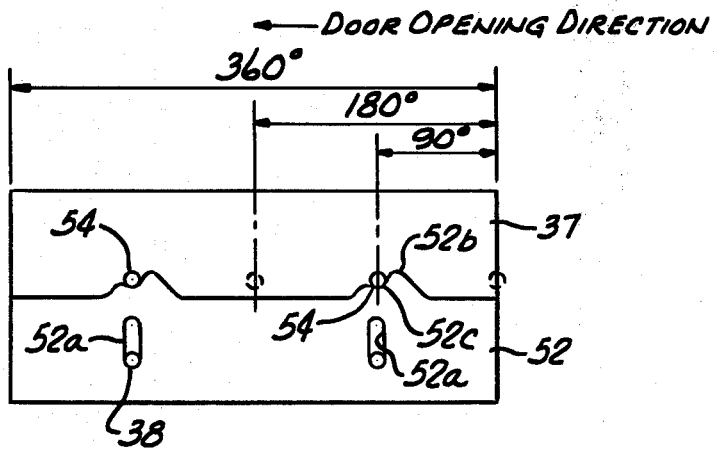
FIG. 7 is a diagrammatically developed view of the door stopper mechanism in FIG. 4 illustrating the mechanism for keeping the door open at a predetermined position.
Figure 4:
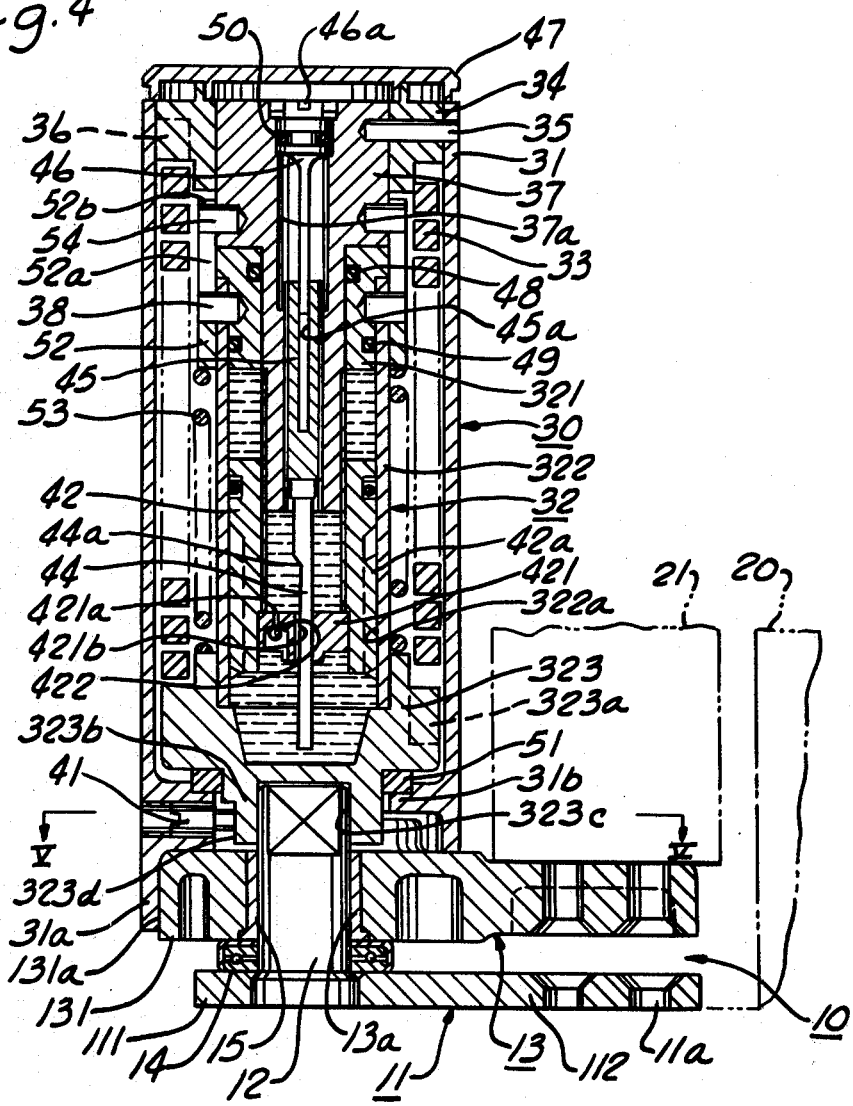
FIG. 4 is a vertical sectional view of another embodiment of this invention.

Referring to FIG. 7, the angular relation between each axial projection 52*b* and a corresponding pin 54 is so selected that the pin 54 may go over the corresponding axial projection 52*b* at a time when the door opens at a predetermined door stop angular position such as 90°. Thus, the door is kept open at the predetermined door opening angular position, because the relative rotation of the damper shaft 37 and the cylinder member 32 is prevented by the engagement between the pin 54 and the axial projection 52*b* of the ring 52.

The axial projection 52*b* is preferably formed with a depression 52*c* at the projecting end as shown in FIG. 7. When the pin 54 is received in the depression 52*c*, the door is kept at the door opening angular position without any movement of the door.

In order to close, or further open, the door from this stop position, an external force in direction of door closure, or door opening, must be given to the outer sleeve 31 through the door. As a result, the ring 52 is pushed down against the urging force of the coil spring 53 by the pin 54 going over the projection 52*b*, so that the door is automatically closed by restoring force of the coil spring 33, or is further opened by the external force.

Figure 9:
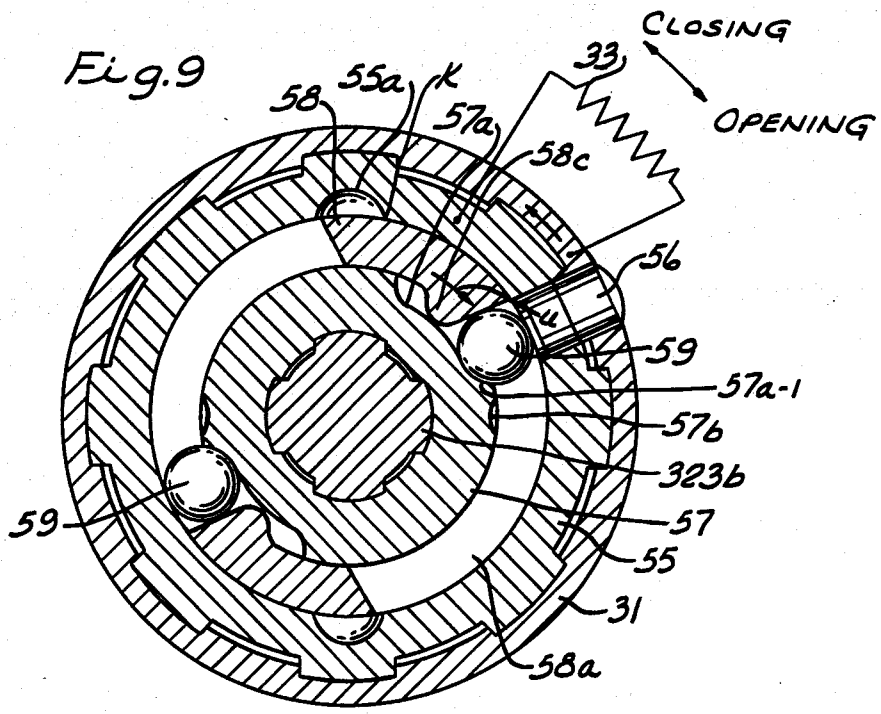
FIG. 9 is a cross-sectional view as seen along the section line IX—IX in FIG. 8.
Figure 6:
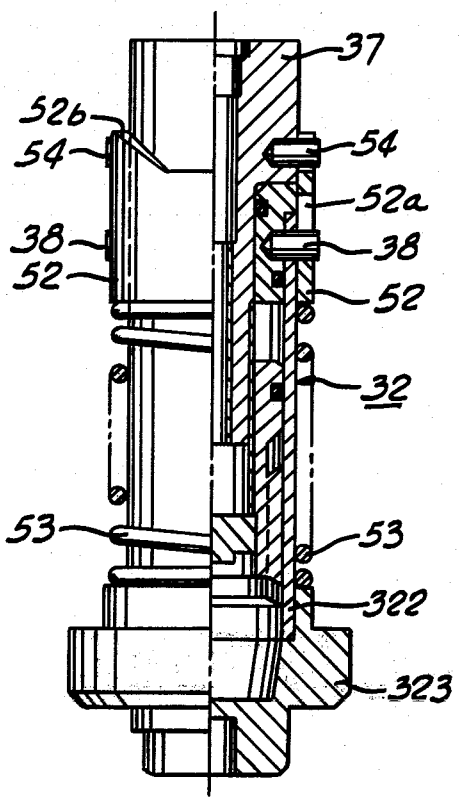
FIG. 6 is an elevational view of the inner cylinder member, including the door stopper mechanism, in FIG. 5, which is shown in partial vertical section.
Figure 8:
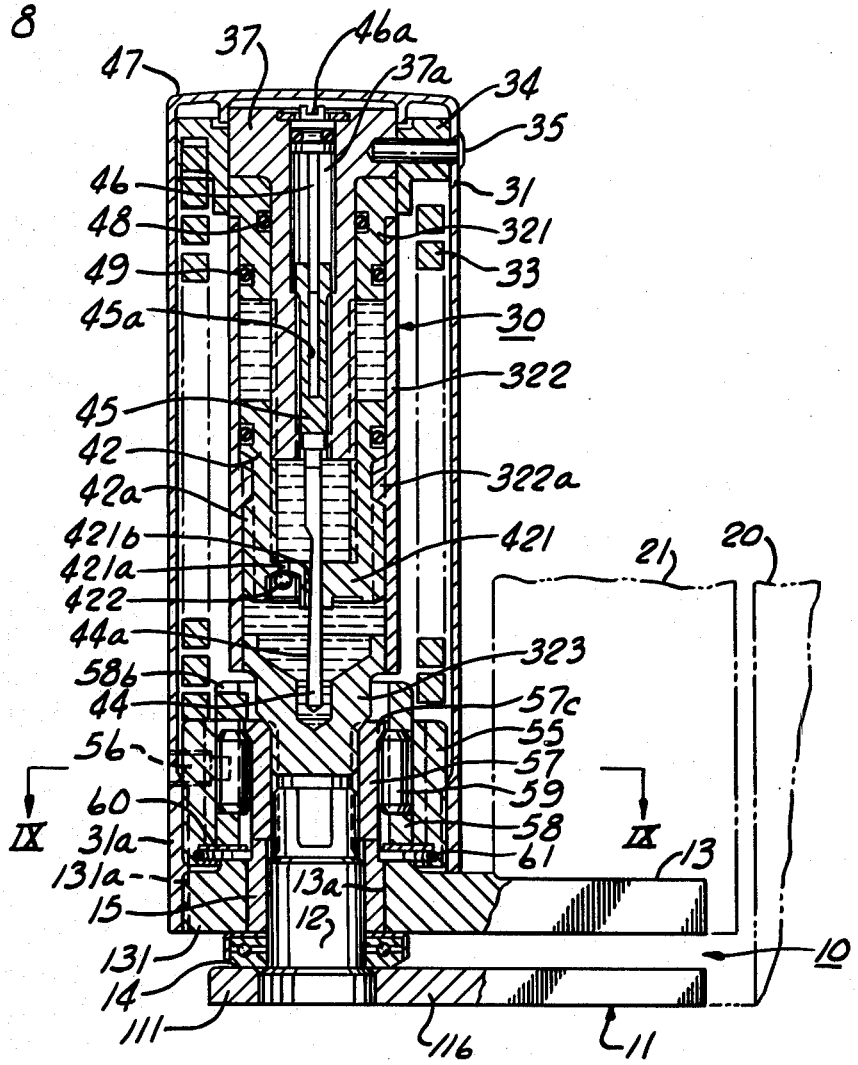
FIG. 8 is a vertical sectional view of a further embodiment of this invention.

Referring to FIGS. 8 and 9, a further embodiment shown is similar to the embodiment of FIGS. 4–7 except for the door stopper mechanism. Similar parts are shown by the same reference characters as in FIGS. 4–7, and description to the similar parts will be omitted for purposes of simplification of the description.

A ring member 55 is fitted into the lower end portion of outer sleeve 31 and secured thereto by a spline connection and a screw 56. Another ring member 57 is disposed in the ring 55 and is connected onto the downwardly extending projection 323*b* of lower cup member 323 by a spline connection. A roller retainer ring 58 is disposed between outer and inner ring members 55 and 57. The roller retainer ring 58 has at least one roller pocket 58*a* (two pockets are shown) in which a roller 59 is disposed. An end plate 60 is disposed in contact with the lower end of the retainer ring 58 and is secured to the outer ring 55 by an O-ring or a snap ring 61. Retainer ring 58 has a cut-away portion 58*b* at the upper end thereof, in which the lower end of coil spring 33 is engaged. Therefore, axial movement of retainer ring 58 is restricted by the spring 33 and the end plate 60. The distance between the outer surface of inner ring 57 and the inner surface of outer ring 55 is shorter than the diameter of roller 59 but longer than the radius of roller 59. Inner ring 57 has at least one groove 57*a* (two grooves are shown) for receiving roller 59. The groove 57*a* angularly extends over a predetermined length. The inner ring 57 has shoulder 57*c* at the upper end adjacent the groove 57*a*. Since the shoulder engages with the roller, inner ring 57 is prevented from axially removing from the projection 323*b* of lower cup member 323.

Outer sleeve 31 has a lower extending portion 31*a* for fitting onto the non-annular peripheral end surface 131*a* of end portion 131 of door supporting plate 13, similar to the embodiment of FIGS. 4–7. The extending end 12*a* of pivot pin 12 is formed with a plurality of axial grooves to be connected with inner ring 57 by a spline connection at a time when the extending end 12*a* is fitted into the bore of the inner ring 57.

Therefore, when the door closing device 30 is assembled onto the pivot hinge 10 by fitting inner ring 57 and the lower extending end 31*a* of outer sleeve 31 onto the extending end 12*a* of pivot pin 12 and the peripheral end surface 131*a* of door supporting plate 13, respectively, inner cylinder member 32 is connected with the pivot pin 12 through the inner ring 57, while the outer sleeve 31 is connected with the door supporting plate 13. Therefore, the outer sleeve 31 rotates in relation to the inner cylinder member 32.

Referring to FIG. 9, since rollers 59 are received in grooves 57*a* and are restricted therein by the inner surface of outer ring 55, retainer ring 58 is prevented by the rollers 59 from moving together with outer sleeve 55 through coil spring 33. Accordingly, coil spring 33 is twisted by door opening, and the restoring force of coil spring 33 provides door closing torque.

In the shown embodiment, inner ring 57 is also provided with two roller receiving shallow depressions **57*b* in the outer surface thereof at different angular positions from grooves 57*a*. And outer ring 55 is also provided with two roller receiving depressions 55*a* at a predetermined angular position with a depth equal to the depth of the groove 57*a*. Each pair of these depressions 57*a* and 55*a* serves as stopper means incorporating with roller 59. A group of groove 57*a*, roller 59, depressions 57*b* and 55*a*** will be described in following description, for purposes of simplification of the description. Similar description will be applicable to another group.

Figure 10:
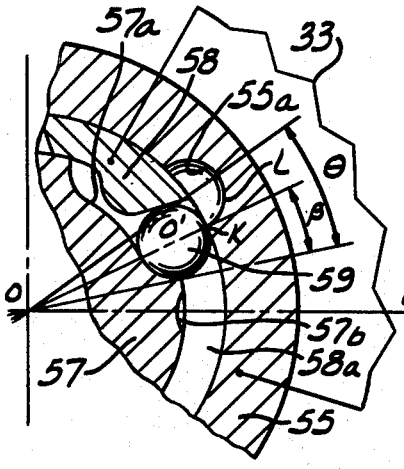
FIGS. 10–13 are cross-sectional views similar to FIG. 9 with portions thereof partially omitted, which illustrate states at different door opening angular positions.
Figure 11:
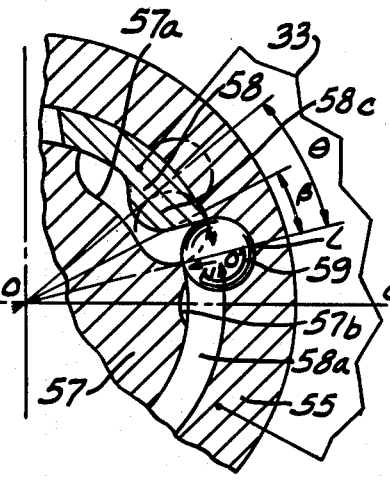

In opening the door, when outer sleeve 31 is rotated from the door closing state in FIG. 9 to a door opening angular position in FIG. 10, coil spring 33 is twisted so that the restoring force U (shown in FIG. 9) urges roller 59 to push out from groove **57*a*. Therefore, when outer sleeve 31 further rotates from the state in FIG. 10, the roller goes into depression 55*a* of outer ring 55 as shown in FIG. 11. When outer sleeve 31 further rotates, roller 59 runs along the outer surface of inner ring 57 together with outer ring 55. Accordingly, retainer ring 58 also moves together with roller 59 and outer ring 55. Therefore, coil spring 33 is not twisted after roller goes into depressions 55*a*. When roller 59 arrives at depression 57*b* of inner ring 57 by further door opening, roller 59 is pushed into depression 57*b* by a centrifugal force N due to the restoring force acting on roller 59 through outer ring 55 and retainer ring 58** as shown by arrows U'.

Figure 12:
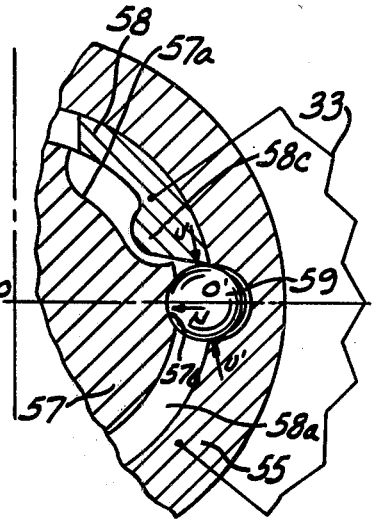

Referring to FIG. 12, since roller 59 is held in the depression **55*a* and 57*b*, roller 59 prevents outer ring 55 from rotating in relation to inner ring 57 and no restoring force acts on the outer sleeve 31 to close the door, so that the door is stopped at the angular position that roller 59 is received in depressions 57*b* and 55*a*. In order to move the door from the stop position, an external force overcoming the centrifugal force N must be given through the door. Thus, roller 59 is pushed out from depression 57*b* and is again moved into depression 55*a* to permit the outer ring 55 to rotate in relation to inner ring 57**.

After roller 59 goes into depression **55*a*, retainer ring 58 moves together with roller 59 and outer ring 55. Therefore, no door closing torque is given to the door at any door opening angular position more than the angular position where roller 59 goes from the depression 57*a* to the depression 55*a***.

Figure 13:
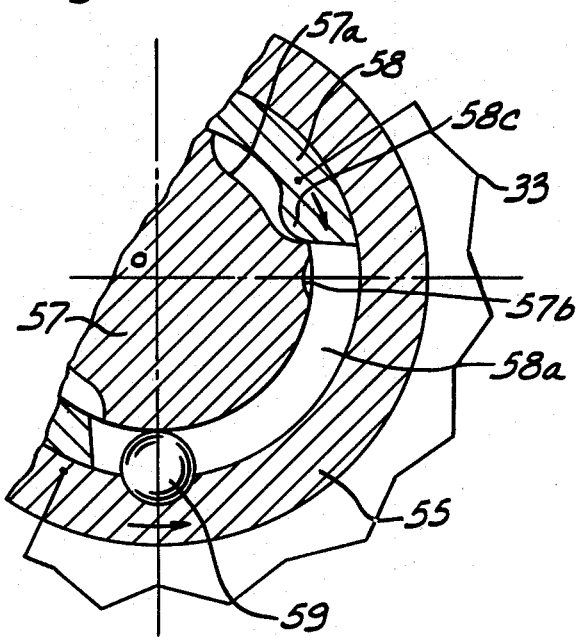

In the shown embodiment, retainer ring 58 is provided with a radial projection **58*c* adjacent to roller 59 in pocket 58*a*. The projection 58*c* is disposed in the corresponding groove 57*a* to be in contact with the roller received in the groove. After roller 59 is removed from the groove 57*a* to fit into depression 55*a*, the radial projection 58*c* comes into contact with the end wall 57*a*-1 of the groove 57*a* during the further rotation of outer ring 55 by further door opening. Therefore, retainer ring 58 is prevented from rotation together with roller 59 and outer ring 55 as shown in FIG. 13, so that coil spring 33 is further twisted by further rotation of outer ring 55** together with the door.

Referring to FIGS. 10 and 11, in door opening, after the preceding edge K to the center L of the depression **55*a* reaches the extension of the line 0—0' connecting the center 0 of inner ring 57 and the center 0' of roller 59, the moving angle $\beta$ of roller 59 around the inner ring 57 required to completely fit into the depression 55*a* is smaller than the rotating angle $\theta$ of the outer ring 55 and, therefore, the outer sleeve and the door also move during the same time. Accordingly, the coil spring is still twisted by door opening but less in relation to door opening angle. Thereafter, coil spring 33 is not twisted by further door opening, as above described. During further door opening, coil spring 33 is again twisted after retainer ring 58 is stopped by the engagement of the radial projection 58*c* with the end wall 57*a*-1 of the groove 57*a***.

In the shown embodiment, the depression **57*b* for the stopper mechanism is formed at an angular position within the extent of travel where retainer ring 58** moves together with the roller and outer ring.

The screw 56 also serves as a preset screw.

Figure 14:
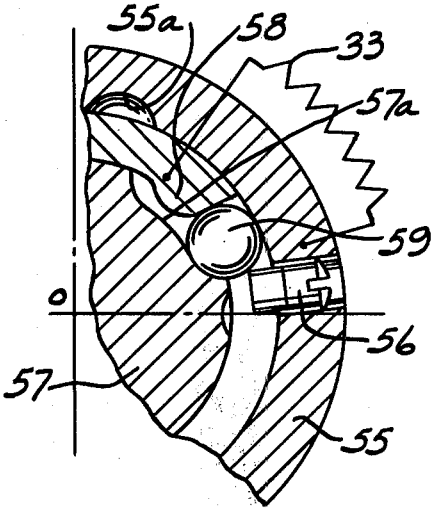
FIG. 14 is a cross-sectional view similar to FIGS. 10–13, which illustrates the preset mechanism.

Referring to FIG. 14, the screw 56 is screwed into the gap between inner ring 57 and outer ring 55 to come into contact with peripheral surface of roller 59 under the condition that coil spring 59 is twisted. Thus, the rotation of outer sleeve 31 together with outer ring 55 due to the restoring force of coil spring 33 is prevented by the engagement between the roller 59 and the preset screw 56.

When the set screw 56 is loosened after the door closing device 30 is assembled onto the pivot hinge 10, the door is automatically closed by the restoring force of the spring coil 33.

This invention has been described in detail in connection with preferred embodiments, but these are merely example only and this invention is not restricted thereto. It will be easily understood by those skilled in the art that other variations and modifications can be easily made within the scope of this invention.

What is claimed is:

1. An offset pivot hinge with a door closing device easily and removably assembled thereto comprising:

said offset pivot hinge having a first plate member to be secured to one of a door and a floor or a door frame, a pivot pin secured onto a surface of one end portion of said first plate member, and a second plate member to be secured to the other of the door and the floor or the door frame, and being pivoted on said pivot pin at one end portion thereof; and said closing device comprising an outer sleeve which is easily and removably mounted onto said second plate at one end of said sleeve, an inner member being mounted in said outer sleeve to be rotatable in relation to said outer sleeve and being removably connected to said pivot pin, and a coil spring member disposed within said outer sleeve with one end of said spring being connected to said outer sleeve and with the other end being connected to said inner member so that said coil spring member may be twisted by a relative rotation of said outer sleeve and said inner member to provide the door closing torque.

2. The offset pivot hinge with a door closing device as claimed in claim 1, wherein said door closing device further comprises a mechanism for damping the door closing speed which comprises an oil containing cylinder member and a piston member fitted into said cylinder member, said cylinder member being secured to said inner member and being rotatably supported within, and in relation to, said outer sleeve, said piston member being reciprocable within said cylinder member by the relative rotation of said inner member and said outer sleeve, said piston member being provided with a check valve which permits unidirectional oil flow between both sides of said piston member and an oil hole which permits oil flow between both sides of said piston member, and said check valve preventing the oil from flowing therethrough at a time when said piston member moves due to the door closure, whereby the door closing speed may be damped.

3. The offset pivot hinge with a door closing device as claimed in claim 2, wherein said door closing device further comprises a shaft member secured to said outer sleeve at one end thereof with the other end extending into said cylinder member, said piston member being non-rotatably but axially slidably mounted on said extending portion of said shaft member, with said piston member being screwed into said cylinder member, whereby said piston member may rotatingly reciprocate within said cylinder member by relative rotation of said outer sleeve and said inner member.

4. The offset pivot hinge with a door closing device as claimed in claim 3, wherein said door closing device further comprises said shaft member having an axial hole, a manually operable rod rotatably disposed within said axial hole of said shaft member and being secured to said shaft member, a movable member being disposed in said axial hole of said shaft member, said movable member being screwed to one of the extending end of said operable rod and said shaft member while being connected to the other thereof to be able to be non-rotatably but axially slidable so that said movable member may be axially moved in a direction in dependence on the direction of the rotation of said manually operable rod, and an adjuster rod being secured to said movable member and extending therefrom into said cylinder member through said oil hole of said piston member, said adjuster rod being milled to form a tapered surface whereby an oil passing gap in said oil hole along said tapered surface may be changed by the operation of said operable rod, thereby to adjust the door closing speed.

5. The offset pivot hinge with a door closing device as claimed in claim 1, wherein said outer sleeve is provided with a plurality of first axial projections at said one end, said inner member having a second axial projection at the same end, said second projection being provided with a non-annular first depression in the projecting end surface, said second plate being formed with second depressions which receive said first projections, said second plate having at least one set screw means to secure said first projections which are received in said second depressions, and said pivot pin having an extending end of non-annular section to mate with said first depression, whereby said door closing device may be easily removed by axially drawing said device away from said pivot hinge after loosening said set screw means.

6. The offset pivot hinge with a door closing device as claimed in claim 1, wherein said second plate is formed with a non-annular surface at the peripheral end of said one end portion thereof where said second plate is pivoted on said pivot pin, said pivot pin having an extending end of a non-annular cross section, said outer sleeve being provided with an extending end which has a non-annular inner surface at said one end thereof to be fitted onto said non-annular surface of said second plate, said outer sleeve having at least one set screw means to secure said extending end of said outer sleeve to said second plate, and said inner member having an axial projection which is formed with a non-annular depression in the projecting end surface thereof, in which depression said extending end of said pivot pin is fitted, whereby said door closing device may be easily removed by axially drawing said device away from said pivot hinge after loosening said screw means.

7. The offset pivot hinge with a door closing device as claimed in claim 1, wherein said door closing device further comprises a ring member being axially slidably connected to said inner member and having at least one axial projection at a predetermined angular position, a spring member for urging said ring member in the direction of said projection, and at least one pin member corresponding to said projection and secured to said outer sleeve so that said pin member may go over said projection during the relative rotation of said outer sleeve and said inner member, whereby the door is kept open by the engagement of said projection and said pin member.

8. The offset pivot hinge with a door closing device as claimed in claim 1, wherein said door closing device further comprises a preset screw member radially screwed into said outer sleeve to fix said inner member under the condition that said coil spring is twisted by a predetermined angle whereby the restoring force of said coil spring provides a sufficient door closing torque after said preset screw is loosened.

9. The offset pivot hinge with a door closing device as claimed in claim 1, where said door closing device further comprises a first ring member being fixedly fitted into said outer sleeve and having at least one depression formed in the inside surface, a second inner ring fixedly fitted on said inner member and being disposed inside of said first ring with an annular gap therebetween, said second inner ring having at least one groove of a depth equal to said depression of said first ring, but smaller than said annular gap, in the outer surface thereof which angularly extends over a predetermined extent at a predetermined angular position different from said depression of said first ring, at least one roller member having a diameter equal to the total amount of the depth of said groove and said annular gap and disposed in said groove, a roller retainer ring having at least one roller pocket for containing said roller member and rotatably disposed within said annular gap, said retainer ring being connected to said other end of said coil spring so that said other end of said coil spring may be connected to said inner member through said roller member and said second inner member, whereby said coil spring may be twisted during door opening before said depression of said first ring reaches said roller member in said groove so that said roller is pushed out from said groove into said depression, and said coil spring may be not twisted thereafter.

10. The offset pivot hinge with a door closing device as claimed in claim 9, wherein said second inner ring has an additional depression shallower than said groove in the outer surface thereof at a predetermined angular position away from said groove in a direction of the rotation of said first ring during door opening, whereby said roller member received in said depression of said first ring during door opening may be partially pushed into said additional depression to keep the door opening thereat.

11. The offset pivot hinge with a door closing device as claimed in claim 9, wherein said retainer ring has a radial projection adjacent to said roller member, said radial projection extending into said groove of said second inner ring so as to engage with the end wall of said groove after said roller member is pushed out from said groove into said depression of said first ring, whereby said coil spring may be again twisted by further door opening.

12. The offset pivot hinge with a door closing device as claimed in claim 9, wherein said second inner ring is fitted onto said inner member and non-rotatably connected by a spline connection, and said pivot pin being fitted into said second inner ring and non-rotatably but axially removably connected thereto by a spline connection.

13. The offset pivot hinge with a door closing device as claimed in claim 9, wherein said first ring is non-rotatably connected to said outer sleeve by a spline connection and is prevented from axially moving by at least one screw means which is radially screwed into said outer sleeve and said first ring, said screw means being screwed into said annular gap to engage with said roller member so that the rotation of said outer sleeve may be prevented in the direction corresponding to the door closure under the condition that said coil spring is twisted by a predetermined degree, whereby the door closing torque sufficient to completely close the door may be obtained at a time when said screw means is loosened to remove the engagement of said roller member and said screw means.

* * * * *

UNITED STATES PATENT OFFICE

CERTIFICATE OF CORRECTION

Patent No. 4,325,164 Dated April 20, 1982

Inventor(s) Ryoichi Sasaki

It is certified that error appears in the above-identified patent and that said Letters Patent are hereby corrected as shown below:

On the title page

[75] Inventor: Kyoichi Sasaki should read "Ryoichi Sasaki"

[30] Foreign Application Priority Data should read:

Aug. 19, 1978 [JP] Japan . . . 53-112962[U]

Feb. 14, 1979 [JP] Japan . . . 54-16604 [U]

Feb. 14, 1979 [JP] Japan . . . 54-16605 [U]

Feb. 14, 1979 [JP] Japan . . . 54-16606 [U]

Feb. 14, 1979 [JP] Japan . . . 54-16607 [U]

June 27, 1979 [JP] Japan . . . 54-80078

Signed and Sealed this

*Twenty-third* Day of *November 1982*

[SEAL]

*Attest:*

GERALD J. MOSSINGHOFF

*Attesting Officer* *Commissioner of Patents and Trademarks*